United States Patent [19]

Benetti et al.

[11] Patent Number: 4,934,075

[45] Date of Patent: Jun. 19, 1990

[54] SKI BOOT WITH ANGULAR POSITION ADJUSTMENT

[75] Inventors: Cristiano Benetti, Postioma; Orelio Mogno, Paese, both of Italy

[73] Assignee: Lange International S.A., Fribourg, Switzerland

[21] Appl. No.: 378,600

[22] Filed: Jul. 11, 1989

[30] Foreign Application Priority Data

Sep. 9, 1988 [CH] Switzerland ..... 3387/88

[51] Int. Cl.[5] ..... A43B 5/04

[52] U.S. Cl. ..... 36/120; 36/117

[58] Field of Search ..... 36/117, 118, 119, 120, 36/121

[56] References Cited

U.S. PATENT DOCUMENTS 4,334,368 6/1982 Chalmers, II et al. ..... 36/121
4,615,128 10/1986 Borsoi ..... 36/120
4,685,226 8/1987 Olivieri et al. ..... 36/120
4,756,099 7/1988 Walkhoff ..... 36/120
4,771,555 9/1988 Ohashi ..... 36/117 X

FOREIGN PATENT DOCUMENTS 1164206 3/1984 Canada ..... 36/120

*Primary Examiner*—Paul T. Sewell
*Assistant Examiner*—Andrew D. Meyers
*Attorney, Agent, or Firm*—Kane, Dalsimer, Sullivan, Kurucz, Levy, Eisele & Richard

[57] ABSTRACT

The boot comprises an upper (8) hinged on a shell (1). A device enables the upper to be locked and its inclination to be adjusted in the locked position. This device comprises a cam (10) cooperating with a stop (24) integral with the shell (1). This cam can be actuated by means of a button (15) and it may be retracted by means of a cam lever (18) against the action of a spring (23) so as to release the upper (8).

8 Claims, 7 Drawing Sheets

SKI BOOT WITH ANGULAR POSITION ADJUSTMENT

FIELD OF THE INVENTION

The present invention relates to a ski boot consisting of at least a bottom part intended to surround the foot and of an upper hinged on this bottom part, and comprising, at the rear, means for connecting the upper and the bottom part, these connecting means comprising a cam lever capable of occupying at least two positions, one in which the upper is angularly fixed to the bottom part of the boot with a given angle of inclination and the other in which the upper is free to swing, within certain limits, on the bottom part, means being provided for modifying the inclination of the upper in the angularly fixed position.

PRIOR ART

A device of this type is known from the European Patent 0,134,595. In this boot, the connecting means comprise a rack integral with the upper and a cam lever hinged on the rack inside two guides inside which the pin is able to move parallel to the rack. The cam lever has an eccentric hub acting on a toothed U-piece and is able to occupy three characteristic positions: a position folded down on the boot in which the U-piece is pressed against the rack and in which a male element of the lever is engaged inside a female element integral with the bottom part of the boot, a partially raised position in which the male and female elements are disengaged but the U-piece is still engaged with the rack, and a totally raised position in which the U-piece is disengaged from the rack, the intermediate position being a rest or walking position and the third position an adjustment position. The structure of the connecting means therefore enables the upper to be released from the bottom part of the boot, while retaining the adjustment of the inclination of the upper, contrary to the device described in the patent CH 549 970, in which the inclination adjustment is lost when the lever is folded downward in order to release the upper. However, in this boot according to the prior art, the connecting means are still relatively voluminous and, in the walking or rest position, the cam lever, separated from the boot, may be in the way and is likely to receive knocks.

The object of the present invention is to provide connecting means which satisfy the same conditions as the connecting means according to the prior art, but are simpler and more compact and in which the cam lever may also be folded down against the upper in the walking or rest position.

SUMMARY OF THE INVENTION

In the boot according to the invention the said cam lever is hinged inside a longitudinal groove with a rotating pin passing through the upper substantially perpendicularly and integral, in rotation, with an eccentric cooperating with a seat provided on one of the parts of the boot, the internal end of the said rotating pin penetrating into a seat provided on the bottom part of the boot, so as to lock the upper on the bottom part for a given position of the cam lever, the said pin moreover freely passing through a rotational actuating piece with which it is integral in rotation, this actuating piece having a bearing surface transverse to the pin and located between the cam lever and the upper, an elastic element being arranged between the actuating piece and the internal end of the rotating pin so as to push the said end in the direction of the bottom part of the boot.

The cam lever is preferably made such that it is folded down against the upper in its two positions of use, namely the position where the upper is locked and the position where the upper is released.

The actuating piece is preferably in the form of a shaped and rounded button inside which the cam lever may be folded down, only the end of this cam lever laterally projecting beyond the bottom so as to allow it to be operated.

The eccentric may be in the form of a cam or simply polygonal in shape. As regards the seat with which the eccentric cooperates, it may simply consist of a metal plate having two parallel transverse shoulders.

The connecting means according to the invention are particularly simple and compact.

BRIEF DESCRIPTION OF THE DRAWINGS

The accompanying drawings shows, by way of example, two embodiments of the invention.

DESCRIPTION OF THE PREFERRED EMBODIMENT(S)

Figure 1:
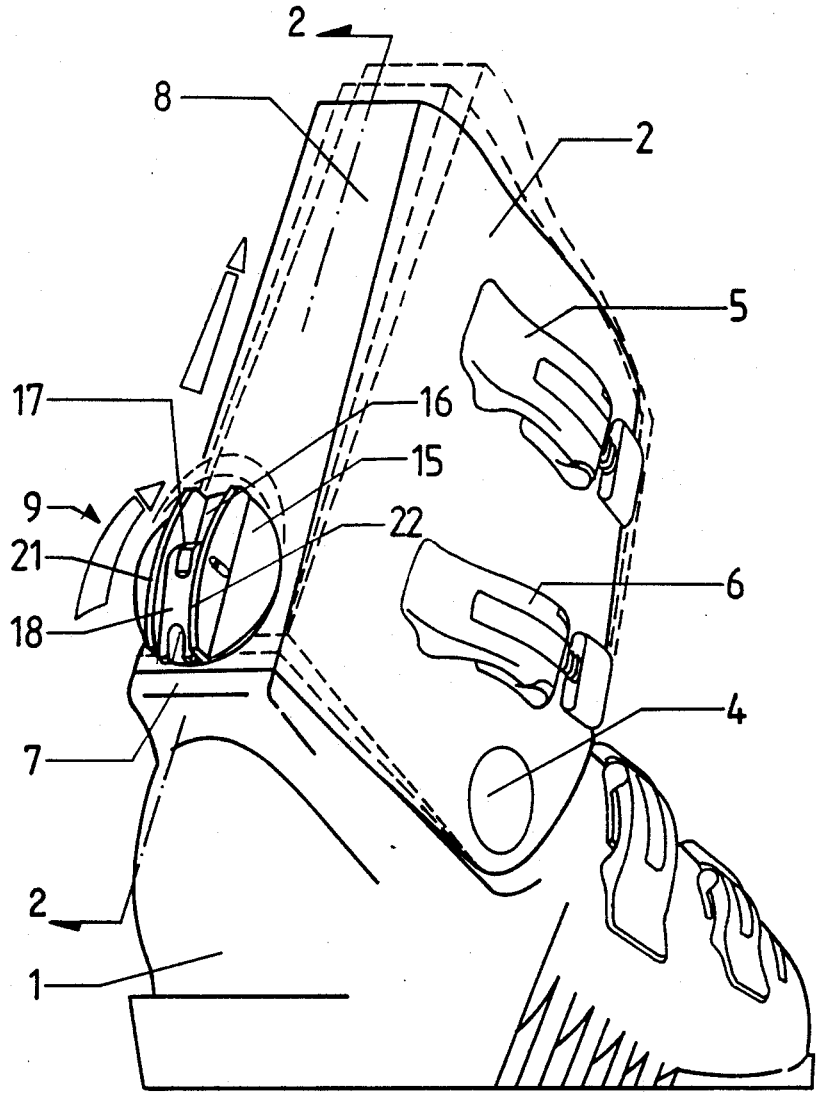
FIG. 1 is a rear perspective view of the boot, applicable to both embodiments.

Reference is made firstly to FIG. 1. The boot partially shown is a shell-type boot of known design. It comprises a bottom part or bottom shell 1 and an upper 2 hinged on the bottom shell 1 at two points 3 and 4. In the embodiment shown, the upper 2 is in principle made as a single piece and it is closed at the front by a flap and two buckles 5 and 6. Backward tilting of the upper 2 is limited by a projection 7 on the bottom shell 1. The rear of the upper 2 has a substantially flat part 8 cooperating with the projection 7 and at the bottom of which there are mounted means 9 for connecting the upper and the bottom shell 1.

Figure 2:
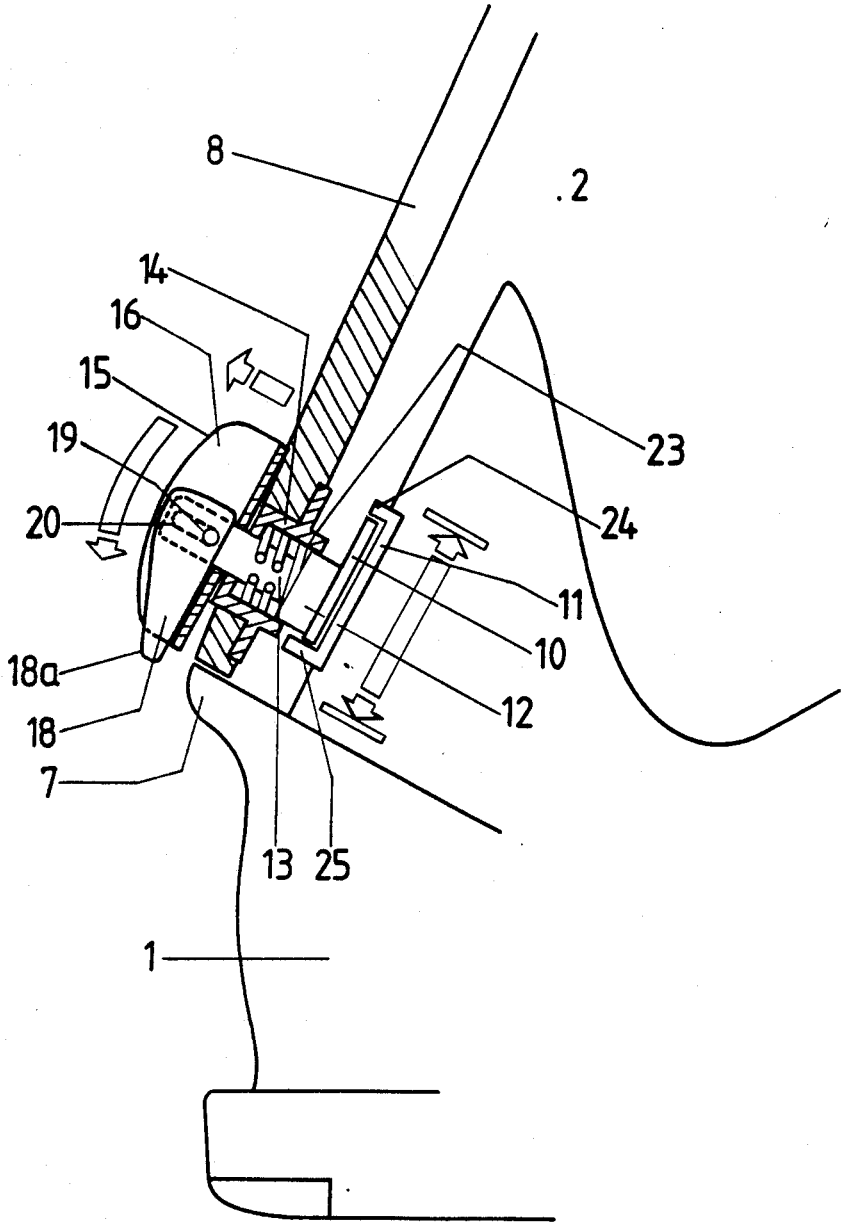
FIG. 2 is a sectional view along II—II of FIG. 1 showing partially the rear of the boot in the position where the upper is locked on the bottom part of the boot, according to a first embodiment.
Figure 3:
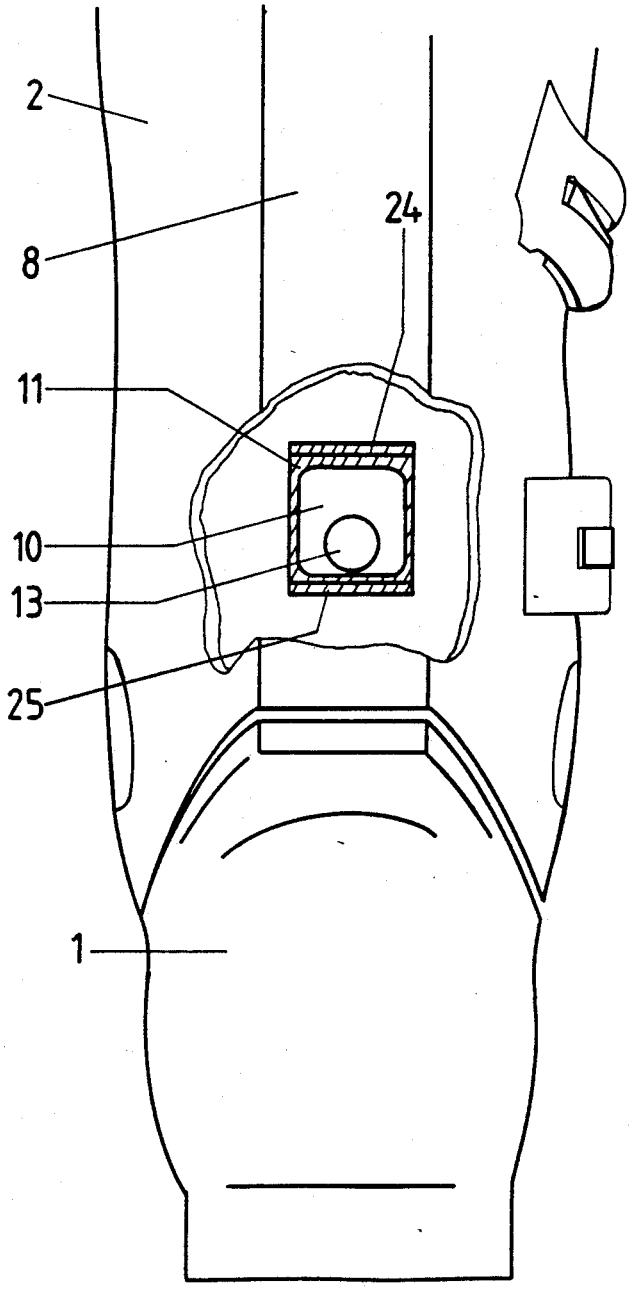
FIG. 3 is a rear view of the boot, according to the first embodiment, in which the upper has been cut away at the location of the means for connecting the upper to the bottom part of the boot.

According to a first embodiment, shown in FIGS. 2 and 3, these connecting means 9 consist of an eccentric 10 integral with the upper 2 and cooperating with a seat 11 integral with the bottom shell 1 (FIGS. 2 and 3). The eccentric 10 is integral with a cylindrical hub 12 itself integral with a pin 13 passing through the rear 8 of the upper via a metal cup 14 inserted inside a hole in the synthetic material of the rear 8 of the upper. The external part of the pin 13 penetrates inside a circular operating button 15 having a diametral groove 16. Inside this groove 16, the pin 13 has an extension with a rectangular cross section 17 on which there is hinged a cam lever 18 having a width corresponding to the width of the groove 16 and hinged on the flat part 17 by means of a pin 19 which is significantly offset relative to the center of the wide part of the cam lever 18. The diametral groove 16 is formed between two rounded ribs 21 and 22 forming a grip for the user so that the button 15 can be rotated and having apertures 20 for the pin 19 to pass through. In the folded-down position of the cam lever 18, its end 18*a* projects slightly outside the groove 16. Inside the metal cup 14, which is optional, there is mounted a helical spring 23 working in compression and consequently pressing the cam lever 18 against the bottom of the groove 16 of the operating button. In the embodiment shown, the eccentric 10 has a square shape (FIG. 3) and the geometrical axis of the pin 13 intercepts one of the axes of symmetry of the square, such that the eccentric 10 is able to assume three given stable positions relative to the seat 11. This seat 11 consists simply of a metal plate provided with the two shoulders 24 and 25, the upper shoulder 24 having a height substantially equal to the thickness of the eccentric 10, while the lower shoulder 25 is higher.

The connecting means 9 enable simultaneously the upper 2 to be released, allowing it a limited pivoting movement on the bottom shell 1, and the inclination of the upper 2 to be adjusted in the position where the latter is locked on the bottom shell 1. These functions will be described in relation to FIGS. 2, 4 and 5.

When the cam lever 18 is in the position shown in FIG. 2, its pin 19 being close to the rear 8 of the upper, the eccentric 10 is engaged inside the seat 11, between the shoulders 24 and 25. The upper 2 is then fixed in rotation on the bottom shell 1. In the position shown in FIG. 2, the inclination of the upper is minimal.

In order to release the upper from the bottom shell 1, it is sufficient to rotate the cam lever 18 about its pin 19 through 180° in the direction of the arrow F1 (FIG. 4), the cam lever 18 being again folded down and almost entirely retracted inside the button 15. The cam lever 18 has the effect of exerting a pulling force on the pin 13 in the direction of the arrow F2, while compressing the spring 23. The eccentric 10 is thus released from the shoulder 24 of the seat 11, thereby enabling the upper to pivot about its hinging point on the bottom shell 1, in particular so as to permit walking.

Figure 4:
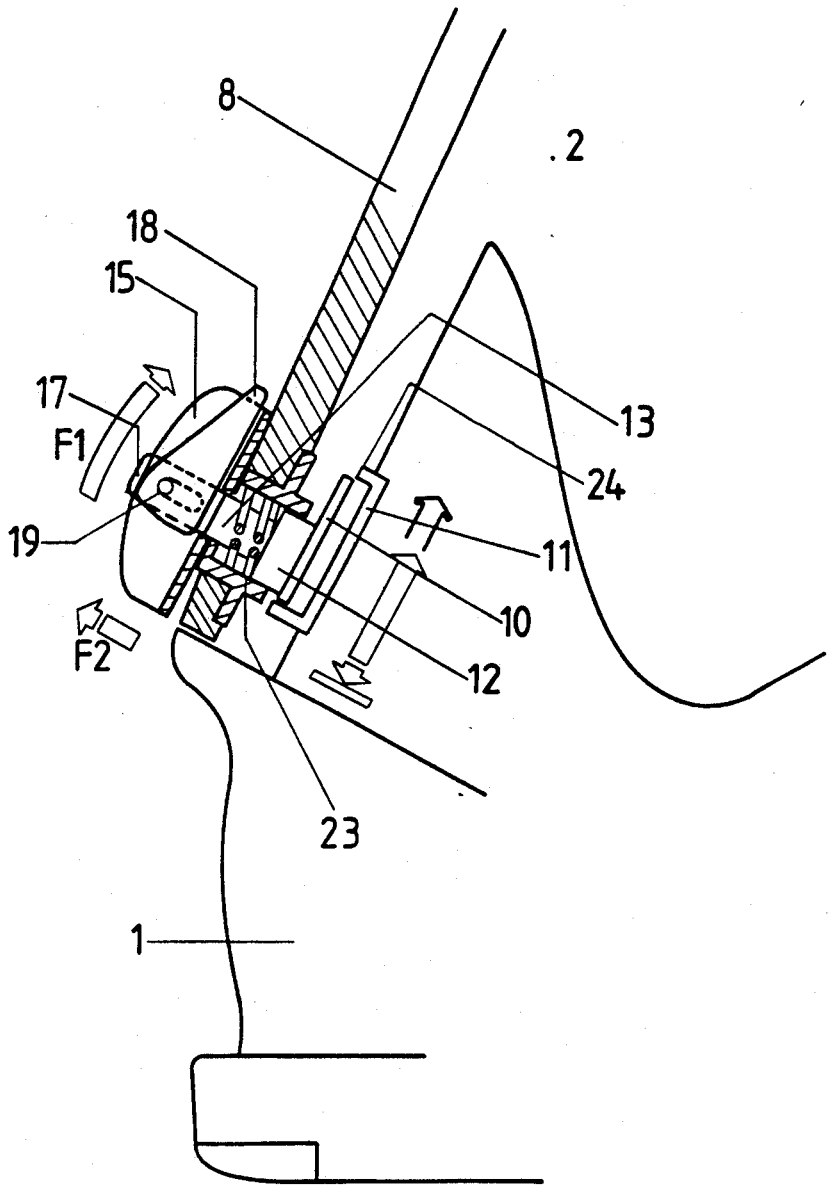
FIG. 4 is a view similar to that of FIG. 2, but showing the upper released from the bottom part of the boot.
Figure 5:
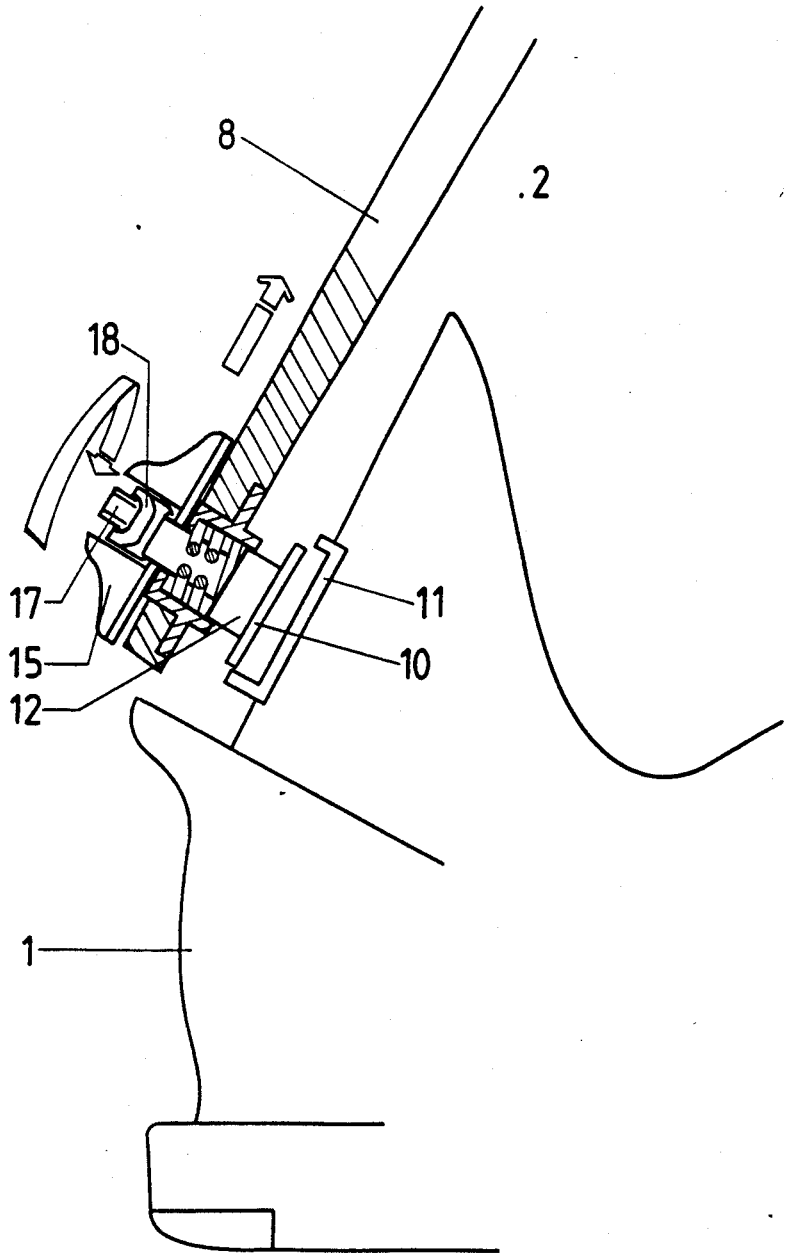
FIG. 5 is a view similar to that of FIG. 4, showing the connecting means in another angular position.

In the position shown in FIG. 4, it is also possible to rotate the button 15, as shown in FIG. 5, namely to modify the position of the eccentric 10. In the case in question, a rotation is performed through 90° or 180°, in one direction or the other. It is then sufficient to bring the cam lever 18 into the position shown in FIG. 2 so as to engage the eccentric 10 inside the seat 11 again. The upper 2 is then locked again, at another angle of inclination.

The hub 12 ensures that the pin 13 is guided inside the cup 14.

The eccentric 10 may have numerous shapes, in particular circular or polygonal shapes.

According to a variation of embodiment, the stop 7 could be eliminated and the shoulder 25 of the plate 11 could have the same height as the shoulder 24. In the position shown in FIG. 5, the eccentric would then be able to pass over the shoulder 25 and the upper 2 of the boot could be positioned upright.

Figure 6:
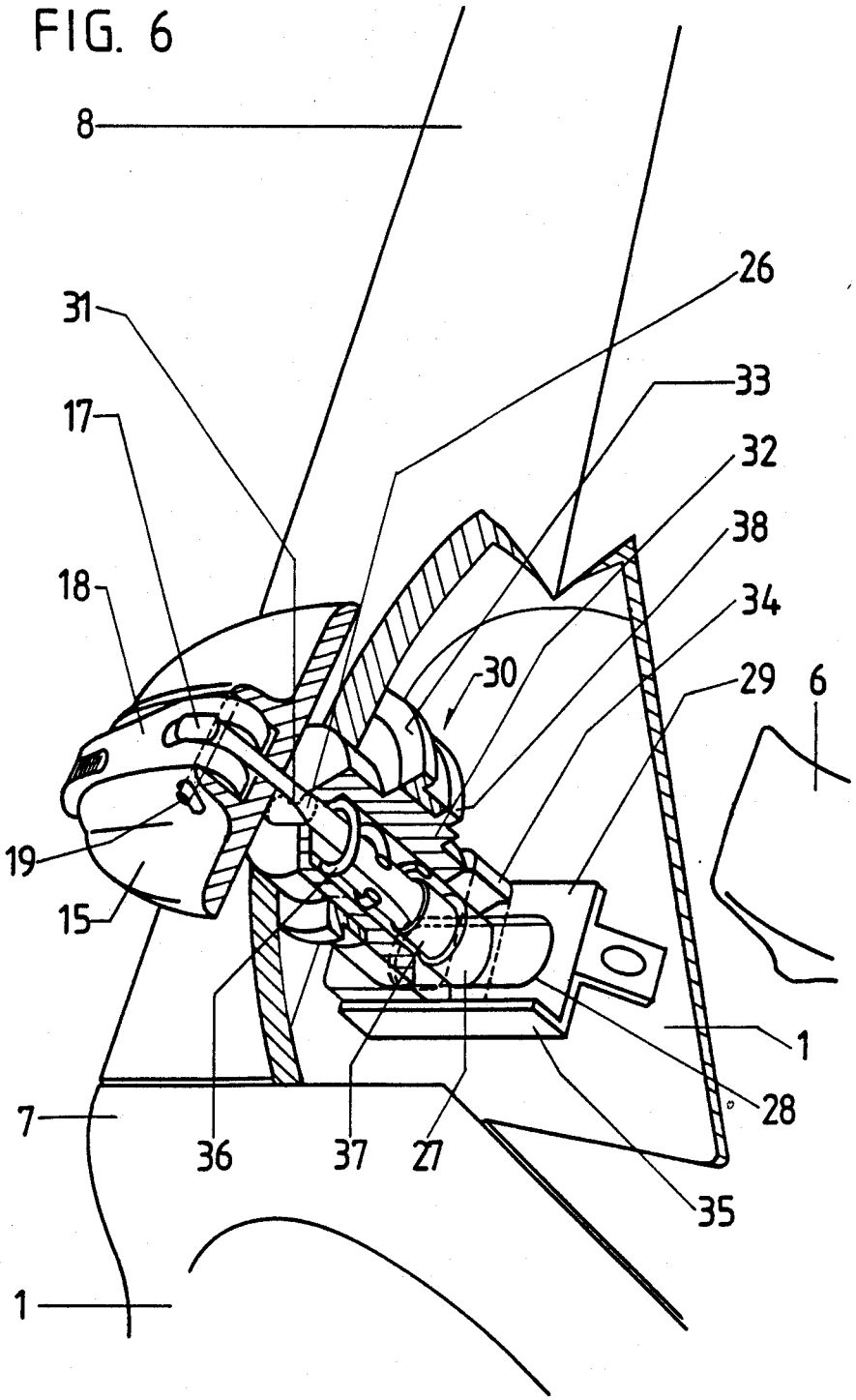
FIG. 6 is a cut-away view of FIG. 1 showing the second embodiment of the connecting means.

The second embodiment, shown in FIG. 6, uses the same operating button 15 and the same cam lever 18 as the first embodiment. The cam lever 18 is integral with a pin 26, corresponding to the pin 13 of the first embodiment, this pin 26 having, over a part of its length, a non-circular cross section gradually tapering so as to form the part 17 integral with the operating button 15. The internal end of the pin 26 ends in a circular head 27 intended to penetrate with slight play inside an oblong opening 28 in a plate 29 fixed onto the bottom of the boot 1, transversely relative to the rear 8 of the upper. The pin 26 is moreover surrounded by a body of revolution 30 locked in rotation with the pin 26 by a rib 31. This body of revolution 30 has an eccentric cylindrical part 32 engaged rotatably inside a bush 33 fixed in the rear 8 of the boot upper. The internal end of this body of revolution 30 ends in a square part 34 which is centered on the pin and one side of which bears against a bent lower shoulder 35 of the plate 29. The pin 26 is surrounded by a helical spring 36 guided radially by a cylindrical part 37 of the pin 26 and working in compression between the head 27 of the pin 26 and the bottom of the body of revolution 30. The body of revolution 30 moreover bears against the internal end of the bush 33 via a bearing surface 38.

In one of the positions of the cam lever 18, the head 27 of the pin 26 is engaged inside the opening 28 of the plate 29 and the upper of the boot is locked on the bottom part. In the other position of the cam lever 18, the head 27 is, on the other hand, not engaged inside the opening 28 such that the upper is able to pivot.

Adjustment of the inclination of the upper is performed by rotating the button 15. Variation of the inclination is ensured by the eccentric part 32. The sole effect of the square part 34 is to determine distinct positions by bearing, with one of its sides, against the shoulder 35 of the plate 29. This square part may be eliminated if continuous adjustment is required. In this case, it would be sufficient to brake rotation of the eccentric by means of a grease friction mounting or by any other means.

Figure 7:
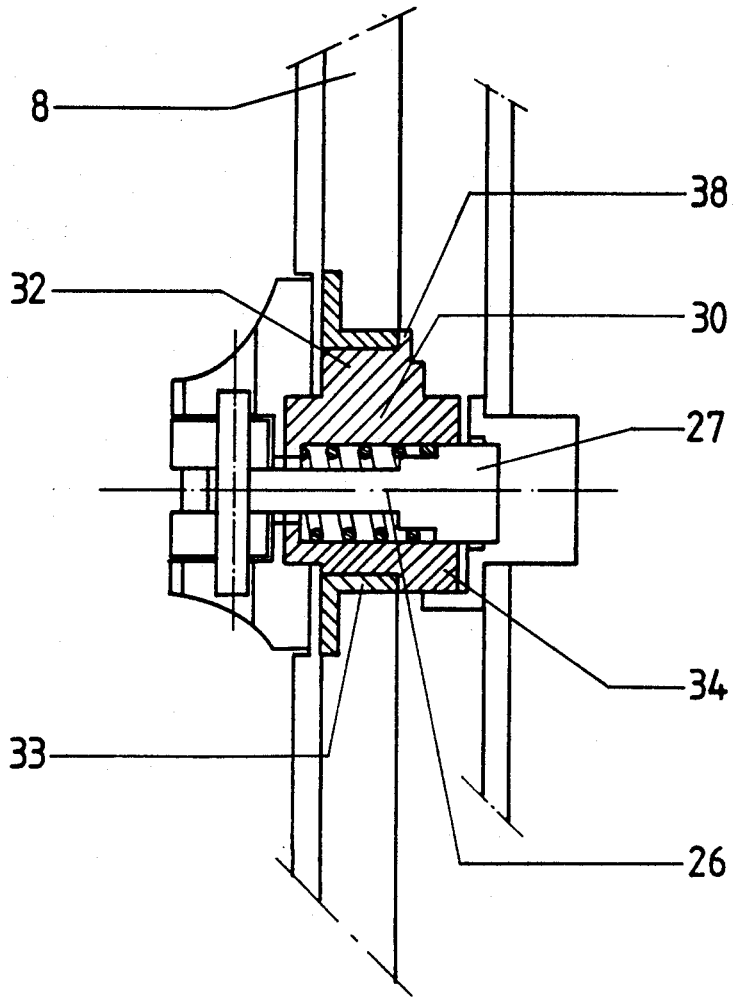
FIG. 7 is an axially sectioned view of the means shown in FIG. 6.

The embodiments described may, of course, be subject to numerous variations without departing from the scope of the invention. In particular, the part 11 of FIG. 2 could be eliminated and replaced by a hollow formed directly in the material of the shell 1. Similarly, in the embodiment according to FIGS. 6 and 7, the part 29 could be eliminated and the stop 35 and the groove 28 could be formed directly in the material of the shell.

We claim:

1. Ski boot consisting of at least a bottom part (1) intended to surround the foot and of an upper (2) hinged on this bottom part, and comprising, at the rear, means (9) for connecting the upper and the bottom part, these connecting means comprising a cam lever (18) capable of occupying at least two positions, one in which the upper is angularly fixed to the bottom part of the boot with a given angle of inclination and the other in which the upper is free to swing, within certain limits preselected to ease walking, on the bottom part, means (10, 11; 30, 29) being provided to modify the inclination of the upper in the angularly fixed position, wherein the said cam lever (18) is hinged inside a longitudinal groove (20) with a rotating pin (13) passing through the upper substantially perpendicularly and integral, in rotation, with an eccentric (10; 30) cooperating with stop means (11; 29) provided on the bottom part of the boot, the internal end of the said rotating pin (13; 26) penetrating into a seat (11; 28) provided on the bottom part of the boot, so as to lock the upper on the bottom part for a given position of the cam lever, the said pin (13) moreover freely passing through a rotational actuating piece (15) with which it is integral in rotation, this actuating piece having a bearing surface transverse to the axis and located between the cam lever and the upper, an elastic element (23) being arranged between the actuating piece (15) and the internal end of the rotating pin (13) so as to push the said end in the direction of the bottom part of the boot.

2. Boot as claimed in claim 1, wherein the said eccentric (10) is fixed to the internal end of the rotating pin, wherein the stop means (25) cooperating with the eccentric (10) form part of the seat (24, 25) into which the end of the rotating pin engages and wherein the said elastic element bears against this eccentric (10).

3. Boot as claimed in claim 2, wherein the said eccentric has a polygonal, in particular square shape.

4. Boot as claimed in claim 2, wherein the eccentric has a circular shape.

5. Boot as claimed in claim 2, wherein the said pin (13) is mounted on the upper (2) by means of a metal cup (14) inside which the elastic element is accommodated.

6. Boot as claimed in claim 1, wherein the said eccentric consists of a cylindrical block (30) mounted slidably on the said rotating pin (26) and inside which there is accommodated a helical spring (36) working in compression between the bottom of its seat and a head (27) of the rotating pin (26).

7. Boot as claimed in claim 6, wherein the seat into which the internal end of the rotating pin (26) engages in a transverse opening (28) provided in a metal plate (29).

8. Boot as claimed in claim 1, wherein the said actuating piece (15) is in the form of a shaped button provided with a diametral groove (16) inside which the said cam lever (18) is accommodated.

* * * * *